US006467446B2

(12) United States Patent
Shin

(10) Patent No.: US 6,467,446 B2
(45) Date of Patent: Oct. 22, 2002

(54) VARIABLE VALVE TIMING SYSTEM FOR VEHICLE

(75) Inventor: Dal-Heun Shin, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/751,304

(22) Filed: Dec. 29, 2000

(65) Prior Publication Data

US 2001/0020456 A1 Sep. 13, 2001

(30) Foreign Application Priority Data

Dec. 30, 1999 (KR) ..... 99-66829

(51) Int. Cl.[7] ..... F01L 1/34
(52) U.S. Cl. ..... 123/90.17; 123/90.31
(58) Field of Search ..... 123/90.15, 90.16, 123/90.17, 90.31

(56) References Cited

U.S. PATENT DOCUMENTS 5,109,813 A * 5/1992 Trzmiel et al. ..... 123/90.15
5,297,508 A * 3/1994 Clarke et al. ..... 123/90.17
5,606,941 A * 3/1997 Trzmiel et al. ..... 123/90.15
6,155,218 A * 12/2000 Line ..... 123/90.15
6,205,965 B1 * 3/2001 Stephan et al. ..... 123/90.15

* cited by examiner

*Primary Examiner*—Wellun Lo
(74) *Attorney, Agent, or Firm*—Christie, Parker & Hale, LLP

(57) ABSTRACT

A variable valve timing system for a vehicle includes an intake camshaft for operating an intake valve, an exhaust camshaft for operating an exhaust valve, an intake cam sprocket mounted on the intake camshaft, an exhaust cam sprocket mounted on the exhaust camshaft, a chain interconnecting the intake cam sprocket and the exhaust cam sprocket, and a device for varying phases of the intake and exhaust camshafts by, according to an engine rpm, pushing and pulling the chain to forcedly rotate the intake and exhaust cam sprockets at a predetermined angle while moving in a perpendicular direction with respect to a longitudinal direction of a power transmission member.

4 Claims, 3 Drawing Sheets

VARIABLE VALVE TIMING SYSTEM FOR VEHICLE

CROSS-REFERENCE TO RELATED APPLICATION

This application claims priority of Korea patent application No. 1999-66829, filed on Dec. 30, 1999.

BACKGROUND OF THE INVENTION (a) Field of the Invention

The present invention relates to a variable valve timing system for a vehicle, and more particularly, to a variable valve timing system that can maximize engine output efficiency by adjusting an open/close timing of an intake valve according to an engine rpm.

(b) Description of the Related Art

As shown in FIG. 4, a valve operation mechanism for intake and exhaust valves for an engine includes an intake camshaft 101 and an exhaust camshaft 103 which are independently provided to open and close the respective intake and exhaust valves in a timely fashion.

Furthermore, the exhaust camshaft 103 is driven by power transmitted from a crankshaft 105, and the intake camshaft 101 is driven by power transmitted from the exhaust camshaft 103 via a chain 107.

Here, the intake and exhaust valves are opened and closed in a timely fashion by the intake camshaft 101 and the exhaust camshaft 103. This is called valve timing, in which the intake valve is generally opened before an intake stroke (that is, before a top dead center point), and is closed after the intake stroke is completed (that is, after the bottom dead center point), and the exhaust valve is opened before an exhaust store (that is, before a bottom dead center point) and is closed just after the start point of the intake stroke after the finish point of the exhaust stroke (that is, after the top dead center point).

In addition, there is a valve overlap time between the finish point of the exhaust stroke and the start point of the intake stroke, during which both the intake and exhaust valves are open to completely exhaust the burned gas and increase the charging efficiency of the mixture.

However, in the conventional valve timing, although an overlap angle is uniform, the overlap time is reduced at a high rpm range of the engine, and is increased at a low rpm range. That is, the overlap time is varied according to the engine rpm. Particularly, in the high rpm range, since the overlap time is too short, the mixture being taken in cannot sufficiently expel the burned gas out of the combustion chamber. That is, the conventional valve operation mechanism cannot properly perform its function.

In addition, the chain is designed to be subject to vibration from the crankshaft and the camshaft to generate lateral vibration, causing impact noise with a chain guide and a sprocket.

SUMMARY OF THE INVENTION

The present invention has been made in an effort to solve the above problems.

It is an objective of the present invention to provide a variable valve timing system that can maximize engine output efficiency by properly adjusting an open/close timing of an intake valve according to an engine rpm.

It is another objective of the present invention to provided a variable valve timing system that can prevent impact noise between a chain and a chain guide by absorbing lateral vibration of the chain.

To achieve the above objectives, the present invention provides a variable valve timing system for a vehicle, comprising an intake camshaft for operating an intake valve, an exhaust camshaft for operating an exhaust valve, an intake cam sprocket mounted on the intake camshaft, an exhaust cam sprocket mounted on the exhaust camshaft, a chain interconnecting the intake cam sprocket and the exhaust cam sprocket, and means for varying phases of the intake and exhaust camshafts by, according to an engine rpm, pushing and pulling the chain to forcedly rotate the intake and exhaust cam sprockets at a predetermined angle while moving in a perpendicular direction with respect to a longitudinal direction of a power transmission member.

According to an embodiment of the present invention, the means for varying comprises an auxiliary cam sprocket disposed between the intake and exhaust cam sprockets and engaged with the chain, and means for moving the auxiliary cam sprocket in a perpendicular direction with respect to a longitudinal direction of the chain to push and pull the chain in the perpendicular direction, thereby varying the phase angles of the intake and exhaust camshafts.

Preferably, the means for moving comprises a slide bar for rotatably supporting the auxiliary sprocket, the slide bar being slidably disposed in a cavity formed in a cylinder head and defined upper and lower oil chambers with its ends against the cavity, each of the upper and lower oil chambers connected to an oil pump and an oil tank through intake and exhaust oil passages formed in the cylinder head, respectively, first and second check valves respectively disposed in the intake oil passages communicating with the upper and lower oil chambers, the check valves allowing the supply of oil from the oil pump to the oil chambers and disallowing the supply of oil from the oil chambers to the oil pump, first and second solenoid valves respectively disposed on the exhaust oil passages communicating with the upper and lower oil chambers, the first and second solenoid valves selectively opening and closing the exhaust oil passages, and an electronic control unit for controlling the first and second solenoid valves according to the engine rpm to selectively open and close the exhaust oil passages, thereby sliding the slide bar along the cavity.

The cavity is provided with at least one large diameter portion in which a projection formed on the slidebar is disposed to limit the slide movement of the slide bar to a predetermined length.

The slide bar is provided with a sprocket hole, the auxiliary chain sprocket is rotatably supported in the sprocket hole by a shaft, and a bearing is disposed between the shaft and the auxiliary chain sprocket.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
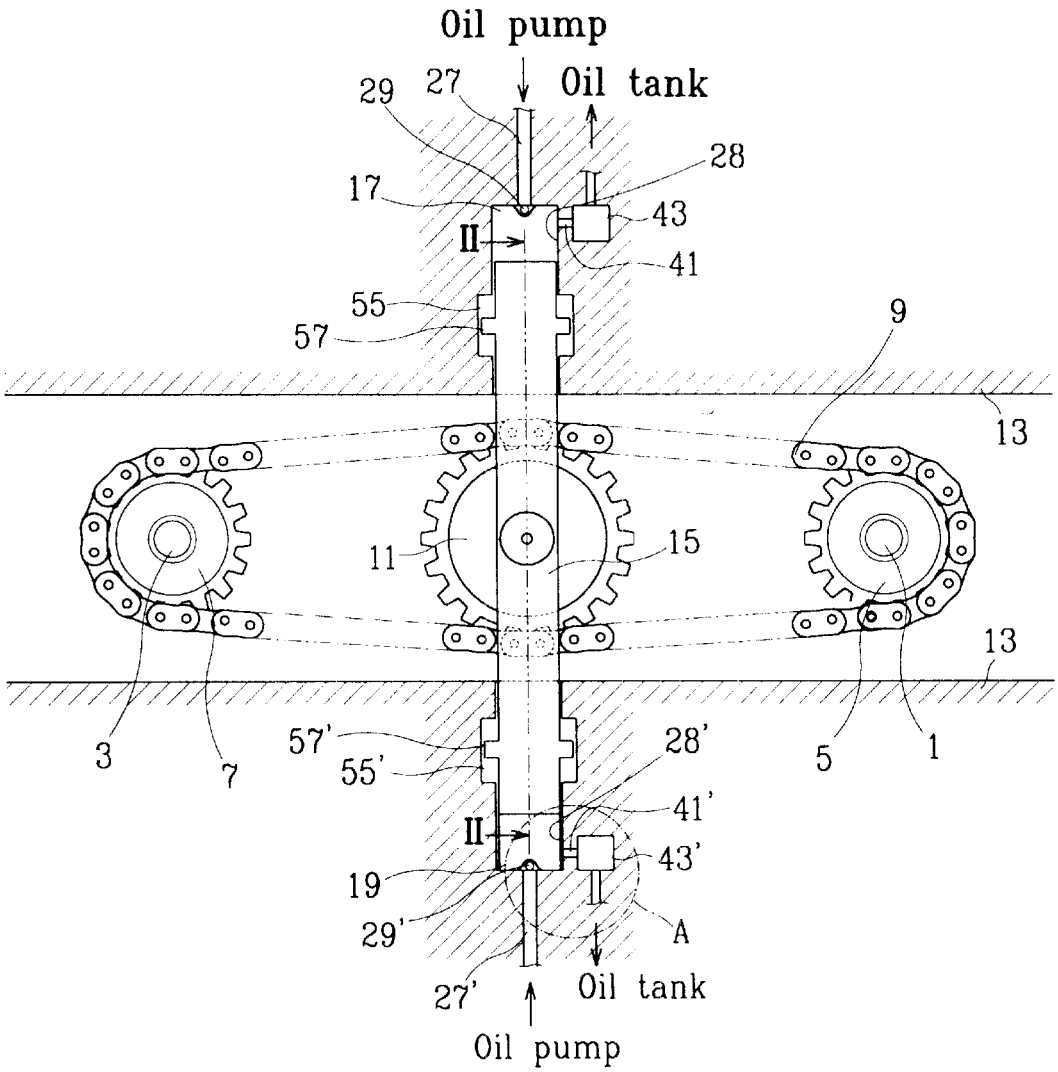
FIG. 1 is a sectional view of a variable valve timing system according to a preferred embodiment of the present invention.

FIG. 1 shows a variable timing system according to a preferred embodiment of the present invention.

In the inventive variable timing system, an exhaust camshaft 1 for operating an exhaust valve (not shown) and an intake camshaft 3 for operating an intake valve (not shown) are separately formed. Mounted on the exhaust and intake camshafts 1 and 3 are respectively exhaust and intake cam sprockets 5 and 7 connected to each other by a chain 9 to transmit rotational power of the exhaust camshaft 1 to the intake camshaft 3.

Between the exhaust and intake cam sprockets 5 and 7, an auxiliary chain sprocket 11 is rotatably disposed and engaged with the chain 9. A slide bar 15 is slidably disposed over upper and lower cavities 28 and 28' of a cylinder head 13, while defining upper and lower oil chambers 17 and 19 in the cylinder head 13.

Figure 2:
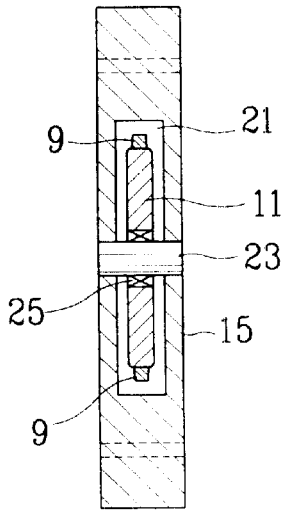
FIG. 2 is a sectional view taken along a line II—II of FIG. 1.

The slide bar 15, as shown in FIG. 2, is provided with a sprocket hole 21 at its central portion such that the auxiliary chain sprocket 11 can be rotatably mounted on the slide bar 15 by a shaft 23. Preferably, a bearing 25 is disposed between the shaft 23 and the auxiliary chain sprocket 11.

Figure 3:
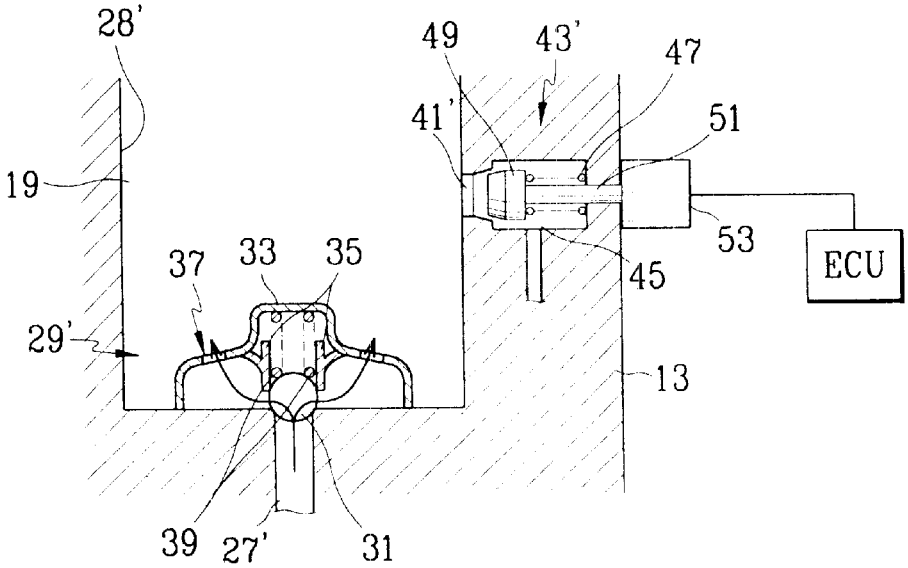
FIG. 3 is a sectional view of a circled portion A of FIG. 1.
Figure 4:
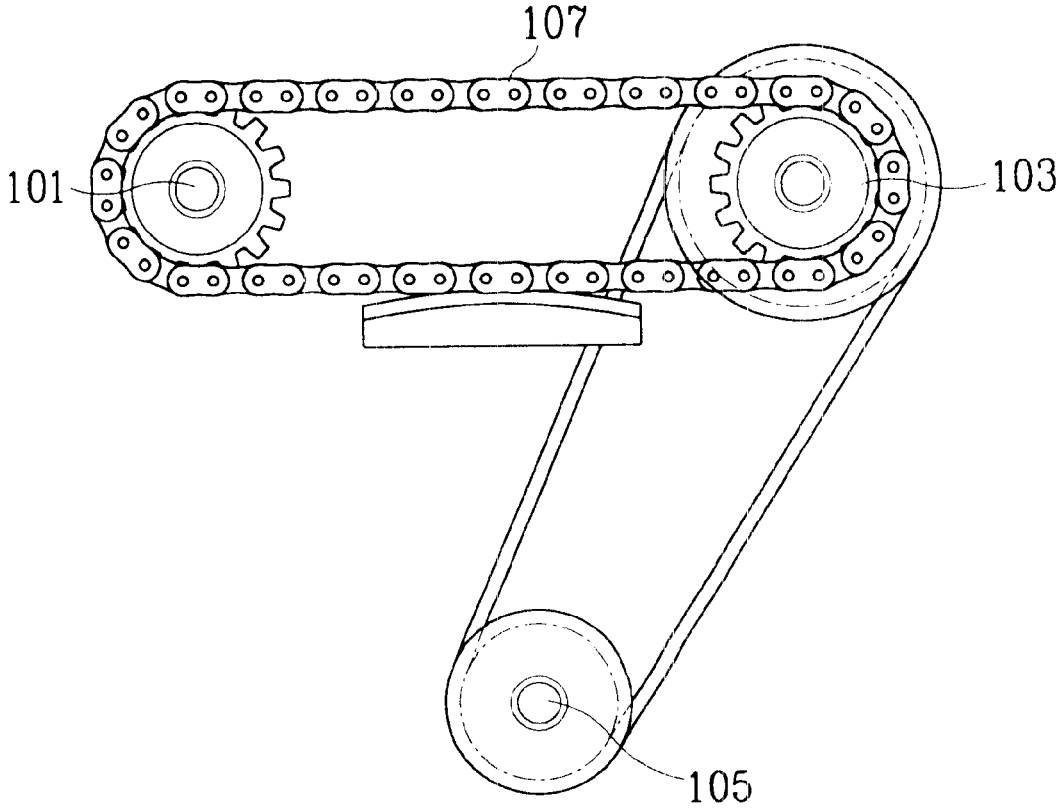
FIG. 4 (Prior Art)
FIG. 4 is a sectional view of a conventional valve operation mechanism.

The upper and lower oil chambers 17 and 19 communicate with an oil pump through intake oil passages 27 and 27', respectively. Check valves 29 and 29' are disposed in the intake oil passages 27 and 27' such that the oil can be supplied only in a direction from the oil pump to the upper and lower chambers 17 and 19. That is, as shown in FIG. 3, each of the check valves 29 and 29' include a check ball 31 disposed in the oil passage (e.g., 27'), a valve housing 33 disposed enclosing the check ball 31, and a guide member 35 disposed inside the valve housing 33 to guide the check ball 31. A plurality of oil holes 37 are formed on the valve housing 33. The check ball 31 is biased by an elastic member 39, disposed between an inner wall of the valve housing 37 and the check ball 31, in a direction where the oil passage is blocked when the oil is not supplied from the oil pump to the chamber.

Referring again to FIG. 1, the upper and lower oil chambers 17 and 19 further communicate with an oil tank through exhaust oil passages 41 and 41', and solenoid valves 43 and 43' are respectively provided in the exhaust oil passages 41 and 41' so as to exhaust oil from within the oil chambers 17 and 19 to the oil tank.

That is, as shown in FIG. 3, an exhaust chamber 45 communicating with the exhaust oil passage 41' is formed in the cylinder head 13, and a valve spool 49 is provided on an operation rod 51 of a solenoid 53 which is controlled by an electrode control unit (ECU). The valve spool 49 is biased toward an exhaust passage blocking position by an elastic member 47.

Referring again to FIG. 1, the upper and lower cavities 28 and 28' are respectively provided with larger diameter portions 55 and 55', and guide projections 57 and 57' are formed on the slide bar 15 such that they are movable in the larger diameter portions 55 and 55', respectively. The larger diameter portions 55 and 55' function as stoppers on which the projections 57 and 57' of the sliders get caught such that the slide bar 15 does not slide over the exhaust oil passages 41 and 41'.

The operation of the above-described variable timing system will be described in detail hereinbelow.

When a signal that the engine rpm is in a predetermined low/medium rpm range is transmitted from an engine rpm sensor (not shown) to the ECU, the ECU controls the solenoid valves 43 and 43' such that the exhaust oil passage 41 is closed and the exhaust oil passage 41' is opened. Accordingly, the oil supplied from the oil pump to the lower oil chamber 19 through the intake oil passage 27' is exhausted to the oil tank through the exhaust oil passage 41'.

Therefore, the slide bar 15 is moved downward to block the exhaust oil passage 41', then stopped by the association of the larger diameter portion 55' and the projection 57'. At this point, oil pressure formed by oil filled in the lower oil chamber 19 by blocking the exhaust oil passage 41' functions as an absorber against the sliding movement of the slide bar 15.

By the downward movement of the sliding bar 15, the auxiliary chain sprocket 11 between the intake an exhaust cam sprockets 7 and 5 biases the chain 9 downward to rotate the intake and exhaust cam sprockets 7 and 5 in opposite directions, as a result of which phase angles of the intake and exhaust cam sprockets 7 and 5 are varied such that the open/close operation of the intake valve is retarded with respect to the open/close operation of the exhaust valve, reducing the overlap section where the intake and exhaust valves are simultaneously open.

When a signal that the engine rpm is in a predetermined high rpm range is transmitted from an engine rpm sensor (not shown) to the ECU, the ECU controls the solenoid valves 43 and 43' such that the exhaust oil passage 41 is opened and the exhaust oil passage 41' is closed. Accordingly, the oil supplied from the oil pump to the upper oil chamber 17 through the intake oil passage 27 is exhausted to the oil tank through the exhaust oil passage 41.

Therefore, the slide bar 15 is moved upward to block the exhaust oil passage 41, then stopped by the association of the larger diameter portion 55 and the projection 57. At this point, oil pressure formed by oil filled in the upper oil chamber 17 by blocking the exhaust oil passage 41 functions as an absorber against the sliding movement of the slide bar 15.

By the upward movement of the sliding bar 15, the auxiliary chain sprocket 11 between the intake and exhaust cam sprockets 7 and 5 biases the chain 9 upward to rotate the intake and exhaust cam sprockets 7 and 5 in an opposite direction, as a result of which phase angles of the intake and exhaust cam sprockets 7 and 5 are varied such that the open/close operation of the exhaust valve is retarded with respect to the open/close operation of the intake valve, increasing the overlap section to improve output efficiency of the engine by improving the volumetric efficiency of the cylinder.

In the above, the auxiliary chain sprocket 11 functions as a chain guide. Therefore, in the present invention, no additional guide member is required. The lateral vibration transmitted from the camshaft and the crankshaft is absorbed by the oil pressure of the upper and lower oil chambers 17 and 19 when the slide bar 15 is moved.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A variable valve timing system for a vehicle, comprising:

an intake camshaft for operating an intake valve;

an exhaust camshaft for operating an exhaust valve;

an intake cam sprocket mounted on the intake camshaft;

an exhaust cam sprocket mounted on the exhaust camshaft;

a chain interconnecting the intake cam sprocket and the exhaust cam sprocket; and means for varying phase angles of the intake and exhaust camshafts by, according to an engine rpm, pushing and pulling the chain to forcedly rotate the intake and exhaust cam sprockets at a predetermined angle while moving in the perpendicular direction with respect to longitudinal direction of a power transmission member;

wherein the means for varying comprises:

an auxiliary chain sprocket disposed between the intake and exhaust cam sprockets and engaged with the chain; and means for moving the auxiliary chain sprocket in a perpendicular direction with respect to a longitudinal direction of the chain to push and pull the chain in the perpendicular direction, thereby varying the phase angles of the intake and exhaust camshafts.

2. The variable valve timing system of claim 1 wherein the means for moving comprises:

a slide bar for rotatably supporting the auxiliary chain sprocket, the slide bar being slidably disposed in a cavity formed in a cylinder head and defining upper and lower oil chambers with its ends against the cavity, each of the upper and lower oil chambers connected to an oil pump and an oil tank through intake and exhaust oil passages formed in the cylinder head, respectively:

first and second check valves respectively disposed in the intake oil passages communicating with the upper and lower oil chambers, the check valves allowing the supply of oil from the oil pump to the oil chambers and disallowing the supply of oil from the oil chambers to the oil pump;

first and second solenoid valves respectively disposed on the exhaust oil passages communicating with the upper and lower oil chambers, the first and second solenoid valves selectively opening and closing the exhaust oil passages; and an electronic control unit for controlling the first and second solenoid valves according to the engine rpm to selectively open and close the exhaust oil passages, thereby sliding the slide bar along the cavity.

3. The variable valve timing system of claim 2 wherein the cavity is provided with at least one larger diameter portion in which a projection formed on the slide bar is disposed to limit the slide movement of the slide bar to a predetermined length.

4. The variable valve timing system of claim 2 wherein the slide bar is provided with a sprocket hole, the auxiliary chain sprocket is rotatably supported in the sprocket hole by a shaft, and a bearing is disposed between the shaft and the auxiliary chain sprocket.

* * * * *